United States Patent [19]

Chiang

[11] Patent Number: 5,035,398

[45] Date of Patent: Jul. 30, 1991

[54] MOUNTING STRUCTURE FOR A SMOKE EXHAUSTER

[76] Inventor: Chao-Cheng Chiang, 293 Pei Tun Road, Taichung, Taiwan

[21] Appl. No.: 508,367

[22] Filed: Apr. 11, 1990

[51] Int. Cl.[5] ..... F16M 5/00

[52] U.S. Cl. ..... 248/674; 248/222.1; 403/348

[58] Field of Search ..... 248/674, 222.3, 222.1, 248/544; 403/348, 349

[56] References Cited

U.S. PATENT DOCUMENTS

| | | | |
|---|---|---|---|
| 2,541,526 | 2/1951 | Lundquist | 403/348 |
| 2,557,223 | 6/1951 | Hans | 248/674 |
| 3,564,984 | 2/1971 | Alexander | 403/348 X |
| 3,860,209 | 1/1975 | Strecker | 403/348 X |
| 4,125,339 | 11/1978 | Pittinger, Sr. et al. | 403/348 |
| 4,171,937 | 10/1979 | Greenfield | 248/674 X |
| 4,372,517 | 2/1983 | Welch et al. | 248/222.3 X |
| 4,513,940 | 4/1985 | Alperin et al. | 248/674 |
| 4,653,708 | 3/1987 | Rich | 248/222.3 X |
| 4,768,545 | 9/1988 | Hoffman | 403/349 X |
| 4,798,129 | 1/1989 | Staub, Jr. | 248/222.1 X |

FOREIGN PATENT DOCUMENTS

| | | | |
|---|---|---|---|
| 574214 | 12/1945 | United Kingdom | 248/27.1 |
| 1438195 | 6/1976 | United Kingdom | 403/348 |

*Primary Examiner*—Gary L. Smith
*Assistant Examiner*—Michael J. Milano

[57] ABSTRACT

Mounting structure for a smoke exhauster comprises a housing having at least an exhaust vent, a smoke outlet, a retaining plate axially corresponding to the smoke outlet comprising an upwardly displaced welding rim, for securing the connection and the positioning of the retaining plate and the housing by welding manners, a receiving opening and a plurality of lug guides, retaining holes and rest surfaces for defining as the connection of a fan motor to the retaining plate by connection means. The fan motor includes a central shaft, a centrifugal fan and a plurality of locking lugs, having respectively a plurality of locking holes and a pair of positioning lips. With the motor top end, locking lugs and the positioning lips respective to the receiving opening, lug guides and rest surfaces, the fan motor is secured in position within the retaining plate. The alignment of the locking holes and the retaining holes are adjustable by clockwise and anticlockwise rotation of the fan motor.

3 Claims, 4 Drawing Sheets

A

MOUNTING STRUCTURE FOR A SMOKE EXHAUSTER

BACKGROUND OF THE PRESENT INVENTION

The present invention is related to a smoke exhauster; more particularly to a mounting structure for a smoke exhauster.

Accordingly, as shown in FIG. 1, the conventional smoke exhauster according to prior art comprises a casing 10 therein having a fixed number of suction ports 11 formed on its bottom. Over each suction port 11, is formed a motor inlet 101 for allowing a fan actuator 12 inserting therethrough. A plurality of locking tabs 121 are formed respectively on its outer circumference near its upper portion. And each locking tab 121 has a screwing hole 122. The insertion of the fan actuator 12 will be stopped against the outside bottom surface by its locking tabs 121, and thus the top end of the fan actuator 12 and a receiving cover 13 will keep a predetermined distance. A plurality of connecting holes 131 are set around the periphery of the receiving cover 13. Around the inner periphery of the motor inlet 101, a plurality of fastening holes 102 are provided for the connection of the fan actuactor 12 and the outer bottom surface of the casing 10. In alignment with the screwing holes 122 and the fastening holes 102 first, then connect the fan actuator 12 and the casing 10 by fastening means 14 such as a plurality of bolts and nuts. Around the outer periphery of the motor inlet 101, a plurality of attaching holes 103 are provided for the connection of the receiving cover 13 and the inner bottom surface of the casing 10. Again, in alignment with the attaching holes 103 and the connecting holes 131 first, then attach the receiving cover 13 to the casing 10 with fastening means 14 such as a plurality of bolts and nuts. Because of the projecting of the fan actuator 12, the receiving cover 13 will protrude over the outside top surface of the casing 10. And this causes several disadvantages:

1) it is difficult to keep its outer configuration neat and clean;
2) it will obstruct the sense of beauty;
3) its simple fastening means may be loose and shaken to cause noise;
4) again, if the bolts or nuts fell from their connected position to suction portion 11, it will be very dangerous.

SUMMARY OF THE PRESENT INVENTION

The present invention provides a mounting structure for a smoke exhauster which comprises a housing having at least an exhaust vent on its inner top surface, a smoke inlet on its outer bottom surface, a retaining plate, including an upwardly displaced welding rim attaching to the inner top surface of the housing by welding manners to form a receiving cavity therein for permitting the clockwise and anticlockwise rotation of the top end of a fan motor therein; and a plurality of connection means.

The fan motor comprises a motor which has provided a central shaft at its bottom therewith being connected a centrifugal fan, extending horizontally and outwardly from the top circumference of the motor a plurality of locking lugs, being located about thereon at equi-angular intervals. Each locking lug has a locking hole and a pair of positioning lips, extending away from the middle portion of its both ends.

The retaining plate has a receiving opening including a receiving opening in its bottom center, a plurality of lug guides being located on the edge of receiving opening respective to and in a similar arrangement as the locking lugs. By this time, with the top end of the motor and the locking lugs respective to the receiving opening and the lug guides, the motor enables to pass therethrough. Respectively next to and in a similar arrangement as the lug guides, a plurality of rest surfaces being provided on the edge of the receiving opening, and extending vertically from thereon to respectively form a reinforcing protrusion being provided for the positioning lips resting thereon, and a retaining hole being located between the reinforcing protrusion and the other edge away from thereon. After the top end of the motor and the locking lugs being positioned within the receiving cavity, the alignment of the locking holes and the retaining holes are adjustable by clockwise and anticlockwise rotations of the fan motor therein.

DETAILED DESCRIPTION OF THE PREFERRED EMBODIMENT

Figure 1:
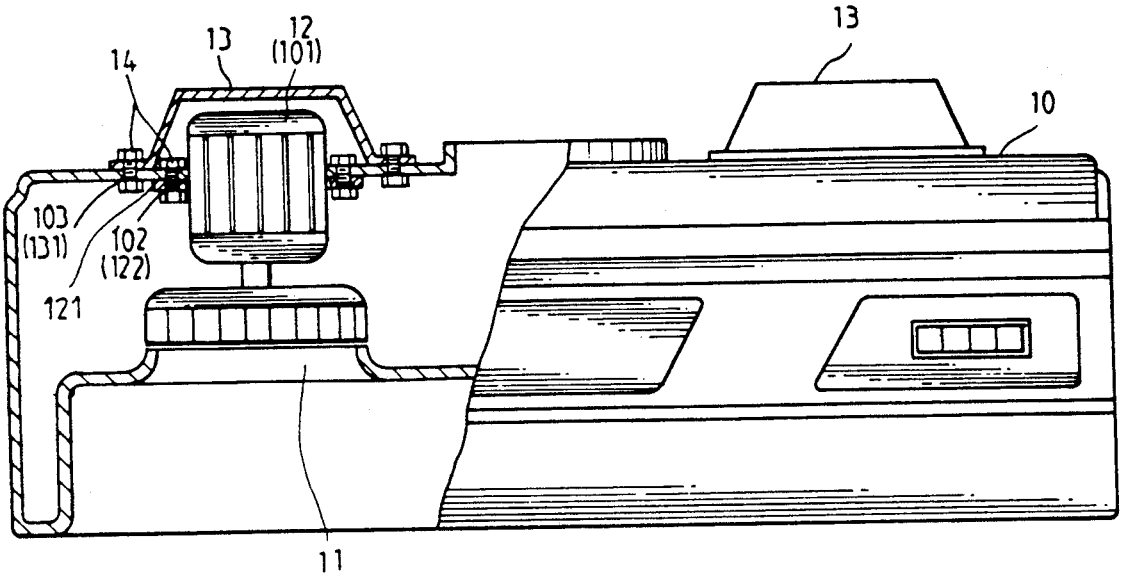
F I G. 1 PRIOR ART
FIG. 1 is an exposed view of the assembly of a conventional smoke exhauster according to the prior art.
Figure 2:
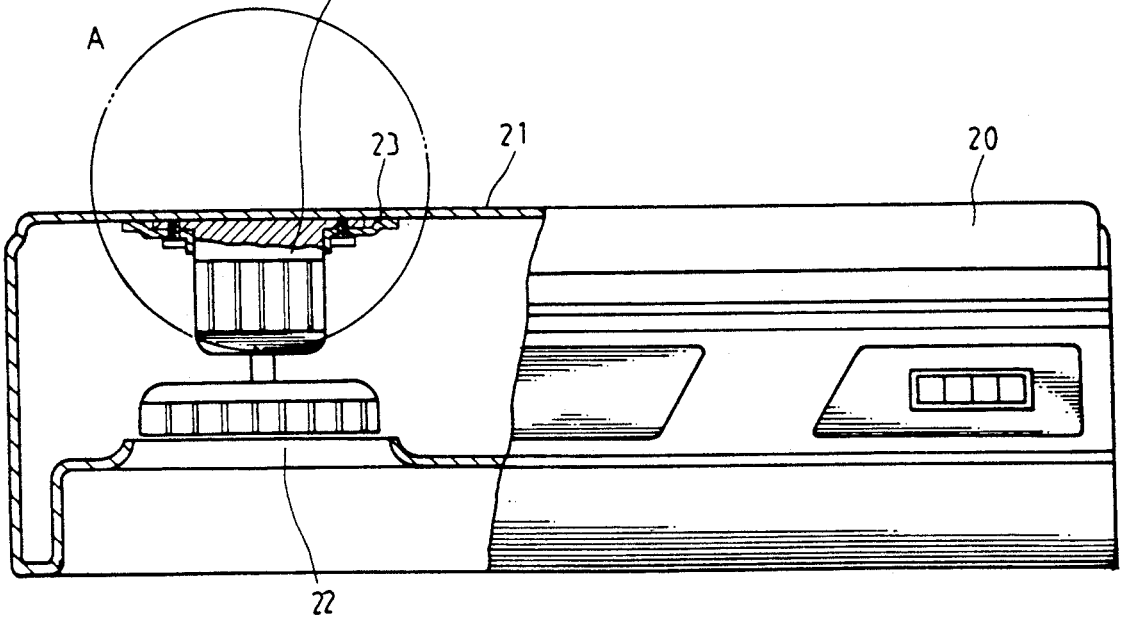
FIG. 2 is an exposed view of the assembly of a smoke exhauster of the preferred embodiment of the present invention.
Figure 3:
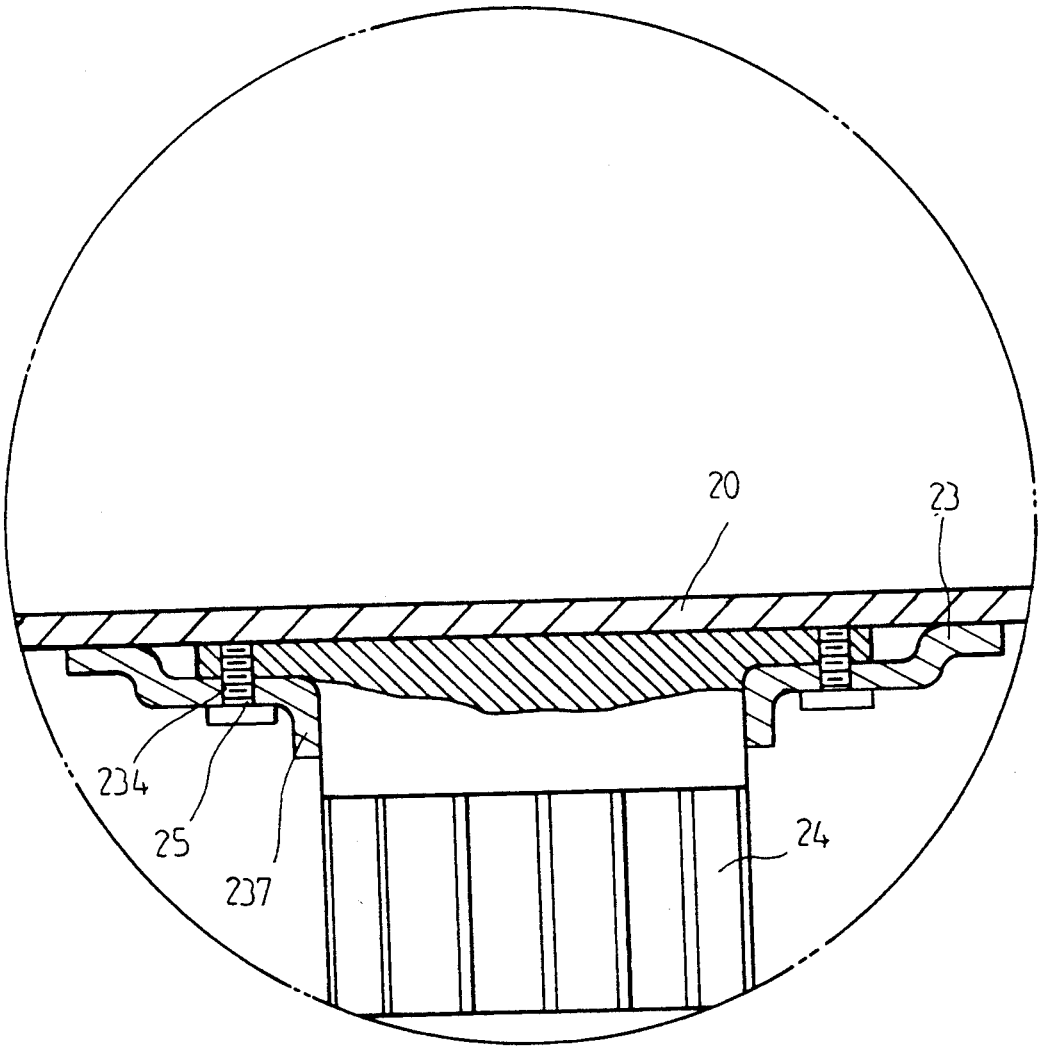
FIG. 3 is a close-up view of A section of FIG. 1.

Referring to FIGS. 2 & 3, the mounting structure for a smoke exhauster comprises a housing 20 having on its inner middle top surface at least an exhaust vent 21, near to both ends of its outer bottom surface two smoke inlets 22, on the inner top surface axially corresponding to each smoke inlet 22 a retaining plate 23, comprising an upwardly displaced welding rim 235 attaching to the inner top surface of the housing 20 by welding manners and provided for ensuring the positioning a fan motor 24, and a plurality of connection means such as bolts and nuts.

The fan motor 24 includes a motor 241 having thereunder provided a central shaft 242 connected to a centrigal fan 243, extending horizontally and outwardly from its top circumference a plurality of locking lugs 244 being located about thereon at equi-angular intervals. Each locking lug 244 contains a locking hole **244*a* near its front edge and a pair of positioning lips 244*b*, extending outwardly from the middle portion of its either side. The centrifugal fan 243 is slightly smaller than the smoke inlet 22** in diameter and placed over thereon.

The retaining plate 23 being in a saucer shape, has in its flat bottom center a receiving opening 231 with a plurality of lug guides 232, and a plurality of rest surfaces 233. The bottom periphery of the retaining plate 23 where the upwardly displaced welding rim 235 curves upwardly is defined as the outer periphery; the other edge being located away from thereon and shaped by the receiving opening 213 and the lug guides 232 is defined as the inner edge which is respectively shared by the lug guides 232 and the rest surfaces 233. The receiving opening 231 is corresponding to the top circumference of the motor 241 in shape. The lug guides 232 are located about the receiving opening 231 in a similar arrangement as and respective to the locking lugs 244. Respectively next to each lug guide 232, each rest surface 233 being positioned in a similar arrangement as each locking lug 244, has a reinforcing protrusion 233*a* formed on its inner edge by extending downwardly from thereon, and a retaining hole 234 being located between its inner edge and the outer periphery of the retaining plate 23 and respective to each locking hole 244*a*.

OPERATION OF THE PRESENT INVENTION

Figure 4:
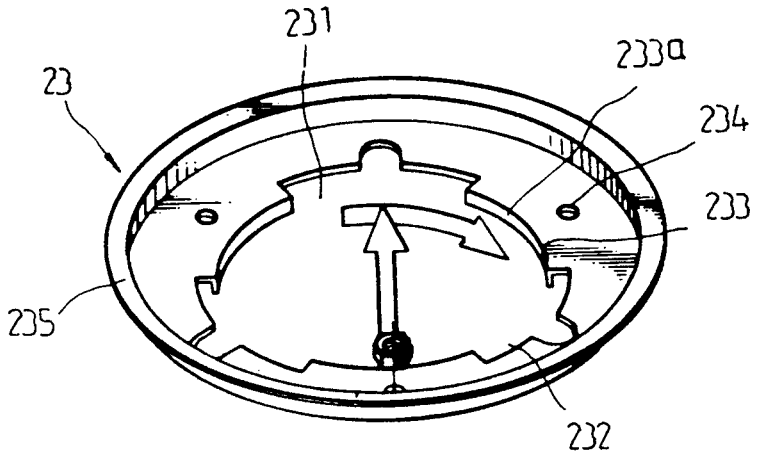
FIG. 4 is a perspective fragmentary view of the device for mounting structure of a smoke exhauster of the preferred embodiment of the present invention.
Figure 4:
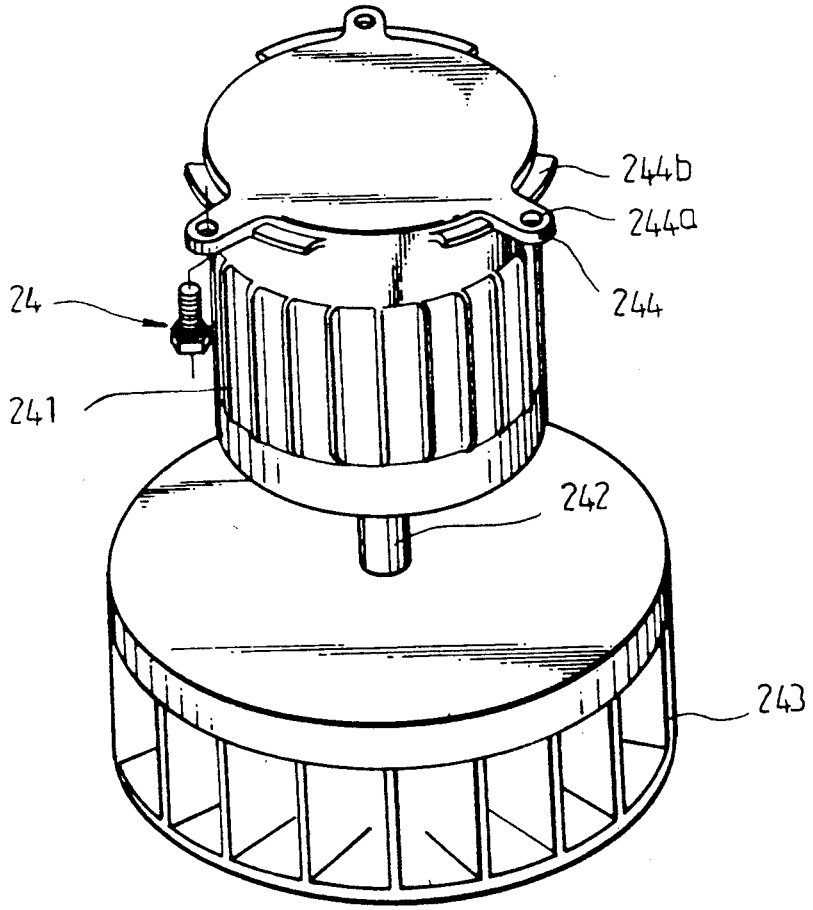
Figure 5:
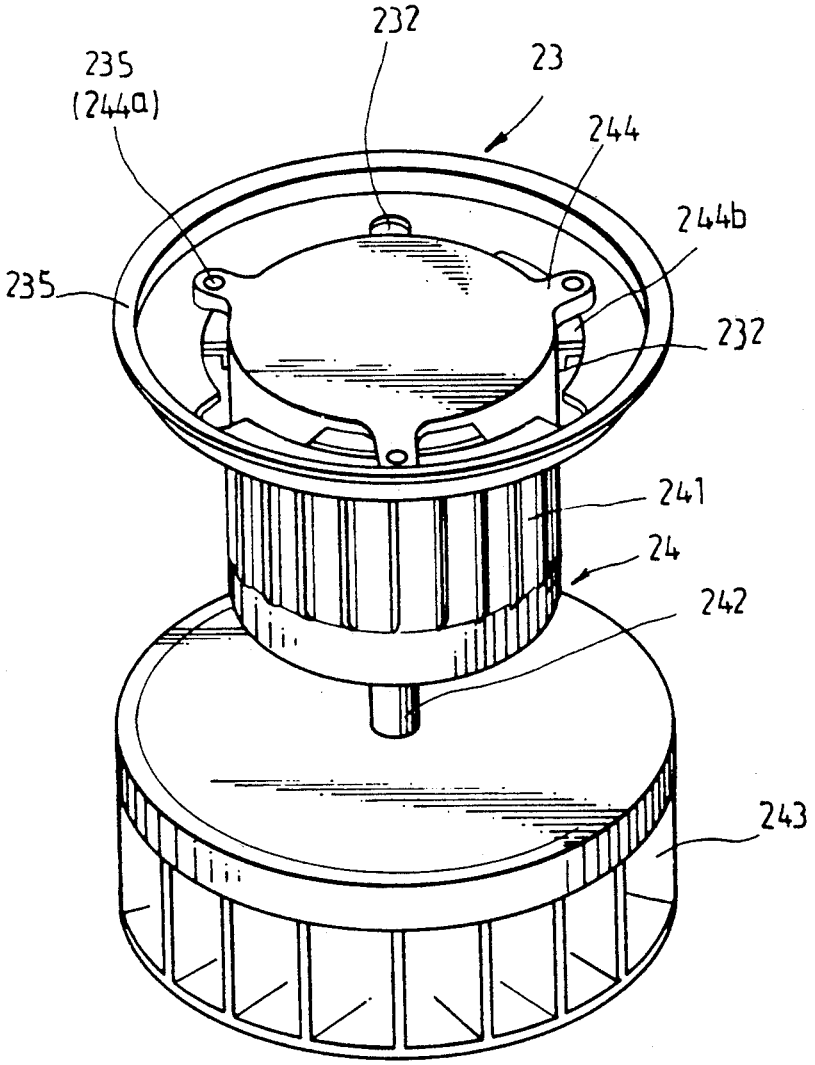
FIG. 5 is an assembled view of the device for mounting structure of a smoke exhauster of the preferred embodiment of the present invention.

Referring to FIGS. 4 & 5, attach the retaining plate 23 to the inner top surface of the housing 20 with its upwardly displaced welding rim 235 by welding manners. The upward curving of the upwardly displaced welding rim 235 ensures a receiving cavity between the inner top surface of the housing 20 and the bottom surface of the retaining plate 23. With the locking lugs 244 and the lug guides 232 respective to each other, then place the fan motor 24 into the receiving cavity through the receiving opening 231. And slightly rotate the fan motor 24 in the retaining cavity of the receiving plate 23 clockwise or anticlockwise until the locking holes 244*a* are respectively in alignment with the retaining holes 234 and the positioning lips 244*b* respectively rest on the rest surfaces 233. Finally, fasten the fan motor 24 to the retaining plate 23 by connection means 25 such as bolts and nuts. Since the centrifugal fan 243 is slightly smaller than the smoke inlet 22 in diameter and placed over thereon, therefore even the connection means become loose, the fan motor 24 will still be retained in the retaining plate 23. The fan motor 24 and the retaining plate 23 are secured in a firm connection, and thus the present invention is completed.

I claim:

1. Mounting structure for a smoke exhauster comprising a housing having at least an exhaust vent, a smoke outlet, on its inner top surface axially corresponding to said smoke outlet a retaining plate, comprising a receiving opening and a plurality of retaining holes, lug guides and rest surfaces for defining as the connection of a fan motor to said retaining plate, a plurality of connection means thereof;

said fan motor including a motor having thereunder provided a central shaft connecting to a centrifugal fan, extending horizontally and outwardly from its top circumference a plurality of locking lugs;

each said locking lug being located about its top circumference at equi-angular intervals and composed of a locking hole near its front edge and a pair of positioning lips on its either side;

said retaining plate, having in its flat bottom center a receiving opening for permitting said motor passing therethrough, oppositely from said receiving opening an upwardly displaced welding rim for defining the connection of said retaining plate and said housing, on the edge of said receiving opening and in a similar arrangement as said locking lugs a plurality of lug guides for permitting said locking lugs passing therethrough, on the edge of said receiving opening and respectively next to said lug guides a plurality of rest surfaces, between the edge of each said receiving opening and the other edge away from thereon a retaining hole being provided in alignment with each said locking hole, between the bottom of said retaining plate and said upwardly displaced welding rim a receiving cavity being formed for permitting the adjusting of the alignment of said locking holes and said retaining holes by the clockwise and anticlockwise rotations of said motor when said locking lugs are placed therein.

2. Mounting structure for a smoke exhauster as claimed in claim 1, wherein each said rest surface having a reinforcing protrusion extending vertically downward from thereunder.

3. Mounting structure for a smoke exhauster as claimed in claim 1, wherein said positioning lips on the edge of said receiving opening and respectively next to and in a similar arrangement as said lug guides a plurality of rest surfaces for permitting said positioning lips resting thereon.

* * * * *